United States Patent [19]

Rose

[11] 4,067,535

[45] Jan. 10, 1978

[54] MULTIPLE USE MIRROR CONSTRUCTION

[75] Inventor: Arnold Rose, Providence, R.I.

[73] Assignee: Trina, Inc., Providence, R.I.

[21] Appl. No.: 770,985

[22] Filed: Feb. 22, 1977

[51] Int. Cl.[2] ..... A47F 7/14

[52] U.S. Cl. ..... 248/470; 248/471

[58] Field of Search ..... 248/12, 127, 470, 471, 248/518

[56] References Cited

U.S. PATENT DOCUMENTS

| | | | |
|---|---|---|---|
| D. 140,582 | 3/1945 | Winslow | 248/470 X |
| 3,385,551 | 5/1968 | McKay | 248/471 X |
| 3,954,247 | 5/1976 | Krusche | 248/471 |

FOREIGN PATENT DOCUMENTS

| | | | |
|---|---|---|---|
| 839,568 | 6/1960 | United Kingdom | 248/471 |
| 1,391,020 | 5/1975 | United Kingdom | 248/126 |

*Primary Examiner*—William H. Schultz

*Attorney, Agent, or Firm*—Salter & Michaelson

[57] ABSTRACT

A mirror construction having three component parts adapted for interengagement in varying use positions including a mirror supporting frame and a separable base, both including mounting means and an intermediate supporting member of generally elongated configuration provided with opposite ends which are selectively adapted to engage with the respective mounting means of said frame and base in friction locking relationship so as to provide for three different mirror support positions.

7 Claims, 9 Drawing Figures

MULTIPLE USE MIRROR CONSTRUCTION

BACKGROUND OF THE INVENTION

This invention relates to a mirror construction and particularly one adapted to assume various support or suspension modes during use. Many constructions for supporting mirrors are known and are commonly referred to by the particular manner in which they support the mirror for use. Thus it is common to suspend mirrors in a hanging position as through the provision of a hook or ring incorporated in a supporting frame and it is known to provide mirrors with a handle for use in a holding position, such mirrors generally being referred to as hanging and hand held mirrors, respectively. A third commonly utilized type of mirror is the vanity mirror. Such a mirror is normally held within a frame which is in turn supported for upright positioning from a base generally adapted to rest on a table or the like. The base, either by its weight, positioning, or a combination thereof, supports the mirror frame in a counterbalanced position so as to provide for useful upright positioning in order that both hands may be free, as in the application of makeup and related cosmetics. During makeup, grooming and the like, a mirror capable of being supported in any one of the above indicated three use positions would be more convenient than one capable of being disposed in only one of said positions. Accordingly, a single mirror construction which could alternatively be used in the various use attitudes above indicated would be particularly convenient and desirable.

It is accordingly a primary object of the present invention to provide a mirror construction capable of use in varying positions or attitudes so as to selectively present a wall suspended mirror, a hand held mirror and a base supported vanity type mirror.

A further object of the present invention is the provision of a mirror construction in which a frame, intermediate support and base portions are capable of interrelated positioning with regard to each other so as to accomplish multiple mirror use attitudes in which such assembly interrelationship is flexible and easily changeable.

A still further object of the present invention is the provision of a mirror construction in which base and frame members are respectively adapted for friction slidable interlocking relationship with an intermediate support member by means of novel structural features which enables the mirror to quickly and easily assume different positions.

These and other objects of the present invention are accomplished by a mirror construction comprising frame, base and intermediate support members in which both the frame and base include mounting means for receipt of opposite ends of the intermediate support member, all three members being interconnected for use as a vanity mirror, the intermediate and frame members being interconnected for use as a hand held mirror, and the frame member being utilized alone for use as a wall hung mirror.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
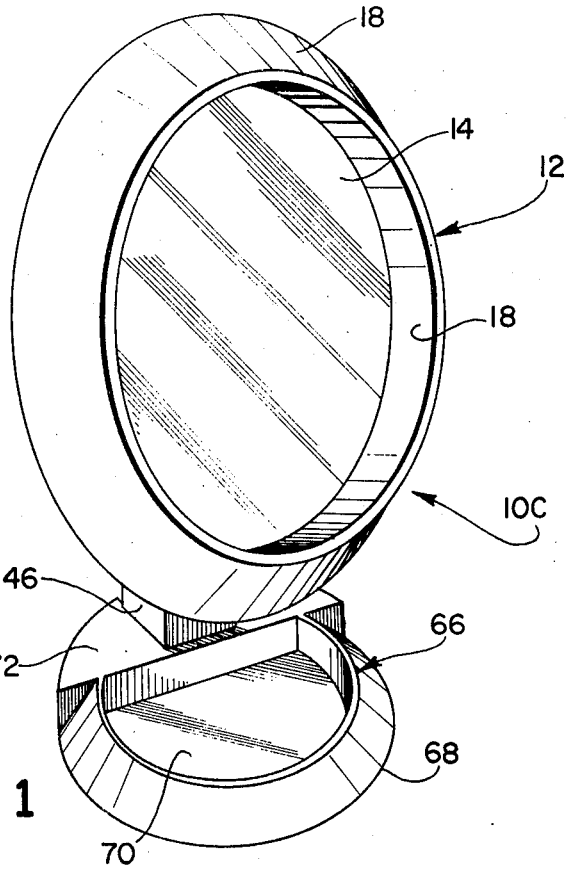
FIG. 1 is a perspective view of a completely assembled mirror construction for use as a vanity mirror.

The mirror construction of the present invention is adapted for use in three alternative use modes, the first as a wall suspended mirror, the second as a hand held mirror, and the third as a free standing vanity type mirror. Such modes are respectively depicted in FIGS. 7, 6 and 1 of the drawings. Thus, in its most simple mode, as a wall hung mirror 10A, the mirror construction includes a frame 12 for supporting a reflecting glass 14. The frame, although illustrated as circular, may take any desired configuration and includes a rear wall 16 and upstanding side walls 18 between which walls the glass 14 is supported by its edges so that the glass and frame form a composite unit. The rear wall of the frame is further provided with mounting means 19 in the form of a box-shaped extension 20. The extension 20 is disposed at the upper portion of the rear wall 16 and includes a transverse wall 22 having a pair of spaced parallel wall portions 24 extending therefrom. A pair of flanges 25 inwardly extend from each of the side wall portions 24 and those portions of the wall 16 underlying such flanges are cut out as at 27 to provide for more efficient molding. That portion of the rear wall 16 disposed proximate to the open end of the walls 24 is provided with a cut out 26 having a flexible web 28 integral therewith and inwardly extending towards said open entrance portion. The web is in turn provided with an upwardly extending detent or stop 30.

Figure 3:
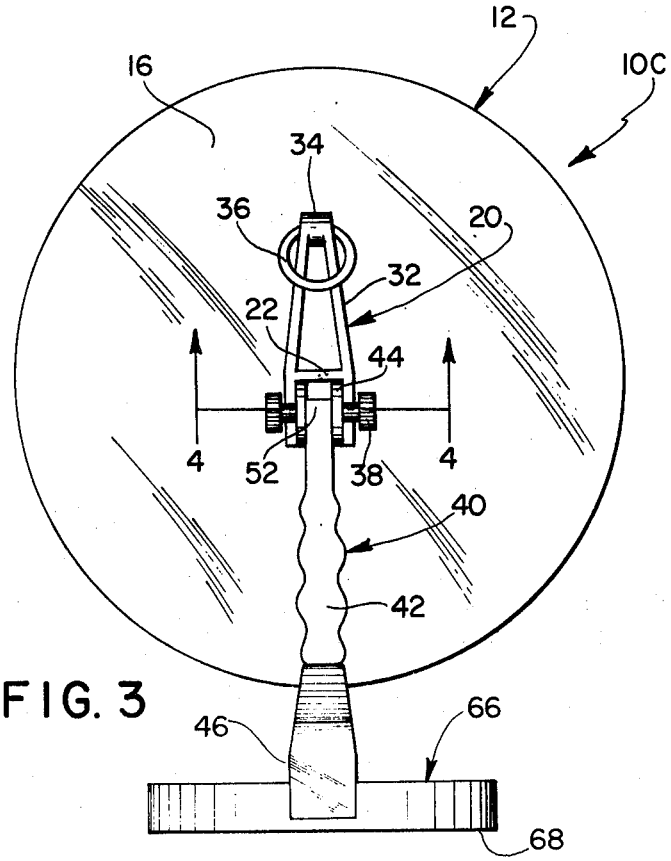
FIG. 3 is a rear view thereof.
Figure 7:
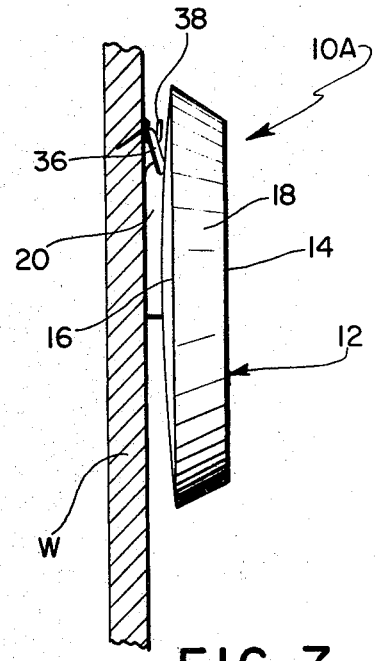
FIG. 7 is a side elevational view of the frame portion of the mirror utilized as a wall suspended mirror.

The extension 20 is further provided with continuing wall portions 32 which, as best indicated in FIG. 3, merge to form a boss portion 34 in which a transversely extending opening is provided for the receipt of a hook or ring member 36 by which the frame 12 may be suspended, as from a wall W through an interengaging hook 38 or similar attachment means. In such form the frame utilized alone forms the mirror construction 10A in its simplest form, i.e., as a wall hanging mirror, as best shown in FIG. 7 of the drawings.

Figure 6:
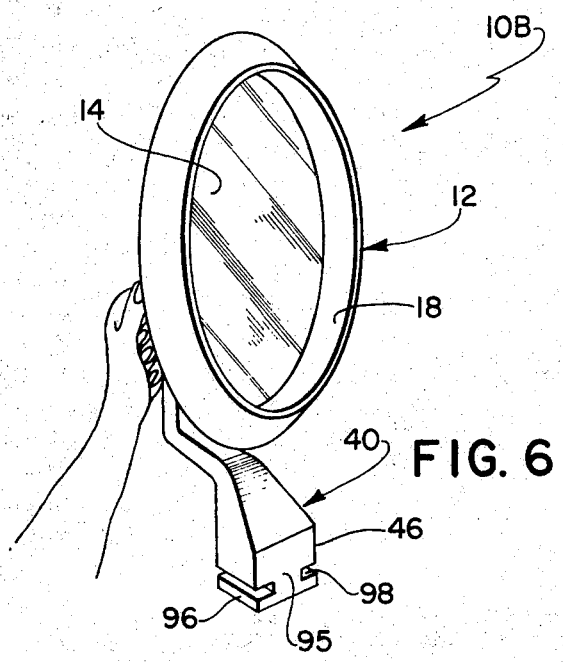
FIG. 6 is a perspective view of the mirror construction with the base portion thereof removed for use as a hand held mirror.

The mirror construction is also adapted for use as a hand held mirror 10B, as best shown in FIG. 6, by the interconnection of an intermediate support member 40 with the frame 12. The intermediate support member 40 is of generally elongated configuration and includes a central portion configured in the form of a handgrip 42 and provided at its upper end with a first headed member 44 and at its lower end with a second headed member 46. The first headed member 44 is adapted to interfit with the mounting means 19 in a manner that will hereinafter be more fully described and includes, as may best be seen by simultaneous reference to FIGS. 2 through 4 of the drawings, a generally flat face portion 48 from which a pair of opposed wings 50 extend and in turn are adapted to receive a terminal extension 52 therebetween. The extension 52 and the wings 50 are each provided with respectively aligned bores to form a cooperating opening 54 through which a threaded shaft 56 extends. The shaft 56 is fixed at one end to a thumb screw 58 and is threadably connected at its other end with a second thumb screw 58. In this manner, the head 44 is pivotably mounted in relationship to te member 40. The terminal end 52 may further be provided with inwardly directed recesses 60 in which flexible washers or grommets 62 are positioned so as to enable a relative tightening between the head 44 and the extension 52, thus enabling either a variable or a fixed positioning of the frame 12 with respect to the support member 40 dependent on how tight the thumb screws 58 are positioned. In addition to the above construction, the head 44 is further provided with a pair of inwardly directed slots 64 positioned above the base surface 48 and below the wings 50.

Figure 4:
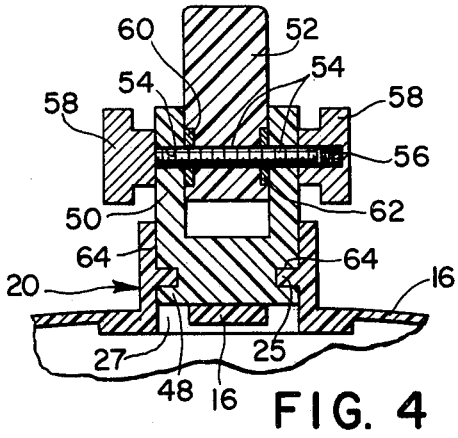
FIG. 4 is a partial sectional view taken along the line 4—4 of FIG. 3.

For use either as a hand held mirror as illustrated in FIG. 6, or as a vanity mirror, as illustrated in FIG. 1, the headed member 44 is adapted for slidable receipt within the mounting means 19 of the frame 12. More specifically, as best shown in FIGS. 3 and 4, the flanges 25 slidably engage within slots 64 until the wings 50 abut wall 22, in which position the frame 12 and support member 40 are fully assembled. Such interfitting slidable relationship is maintained not only through the frictional relationship of the various surfaces in engagement with each other, but also by the disposition of the stop member 30 which acts as a detent to releaseably hold the parts in assembled relation, it being clear that as the plate 48 rides over the web 28, the inherent flexible nature of the latter enables it to downwardly flex to accommodate such action, but once the plate 48 has slid therepast, the web springs upwardly and detent 30 then releaseably maintains the parts in assembled relation. Removal of the member 44 is accomplished by the forced withdrawal of the headed member 44 from the mounting means 19 when combined with the downward depression of the web 28; which action enables the frame 12 to be slidably separated from its intermediate support member 40.

Figure 2:
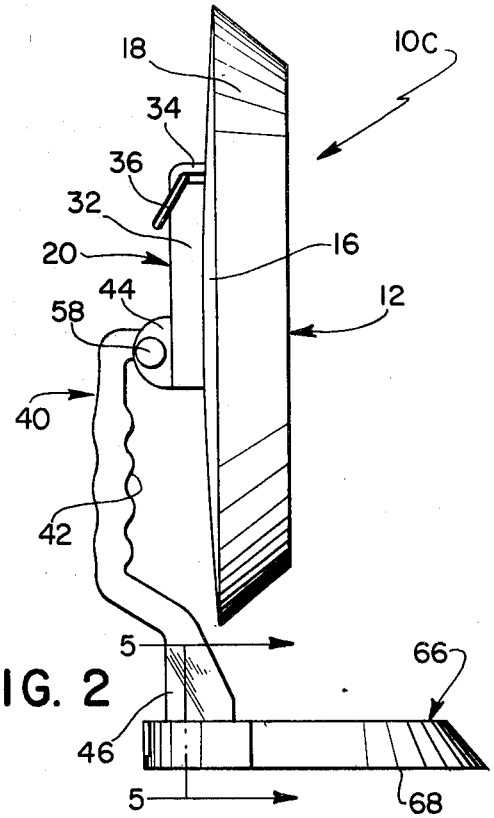
FIG. 2 is a side elevational view thereof.
Figure 5:
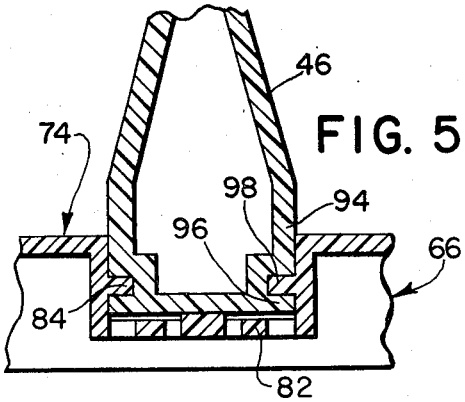
FIG. 5 is a partial sectional view taken along the line 5—5 of FIG. 2.
Figure 8:
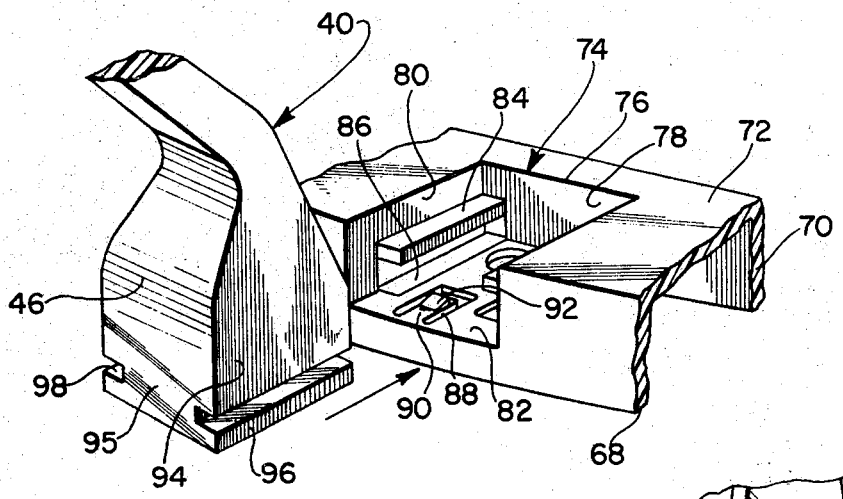
FIG. 8 is a perspective view in partial assembly showing the manner in which the intermediate support member is connected to the base member.
Figure 9:
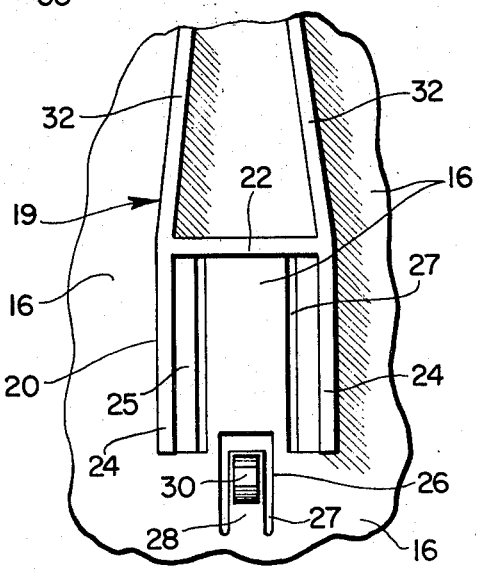
FIG. 9 is a partial rear plan view illustrating the frame mounting means.

The mirror construction of the present invention is also adapted for a third use, i.e., as a vanity mirror 10C, as best illustrated in FIGS. 1 - 3 and additionally in FIGS. 5 and 8. The third component member of the present invention comprises a base 66 having a bottom surface 68 adapted to be positioned on a table or other supporting surface. The base 66 is provided with a central recess 70 which functions as a receptacle for receipt of jewelry, cosmetics or the like. The base 66 is provided at one end thereof with an upstanding platform 72 having mounting means 74 provided therein in the form of a recess 76. The recess is of generally U-shaped configuration having an end wall 78, opposed side walls 80, and a bottom wall 82. The mounting means 74 is similar in construction to the previously described mounting means 19 and is similarly provided with flanges 84 inwardly extending from the side walls 80 and positioned over elongated openings 86 of similar configuration provided through the bottom wall 82 to better facilitate molding.

The bottom wall 82 is further provided with a cut out 88 having an inwardly extending flexible web 90 in turn provided with an upstanding detent or stop portion 92. The mounting means 74, and more specifically the recess 76, is in turn adapted to receive the second end 46 of the intermediate support member 40, which in turn terminates in an enlarged boss 94 having a generally flat plate 96 at the bottom surface thereof and a pair of inwardly directed slots 98. Cooperation between the headed member 94 and the recess 76 is provided by sliding the terminal end 46 into the open end of the recess 76 so that the flanges 84 are aligned within the slots 98 and until forward portions of the boss 94 contact the rear wall 78 thereof. The longitudinal extent of the plate 96 and the positioning of the cut out 88 is such that when the second end 46 is fully received within the mounting means 74, the detent 92 will abut rear portions 95 of the plate 96 to releaseably maintain the part 46 in its assembled position. Removal of the intermediate member 40 from the base 66 is achieved in the same way that the member 40 is removed from the frame 12, as previously explained.

It is accordingly believed that a simple and highly useful mirror construction has been presented by the instant invention in which various combinations may be arrived at by the assembly and disassembly of the frame, base, and intermediate support members thereof in a fast, simple, and efficient manner, and which assures positive but releaseable locking between the various component parts thereof, dependent on the use mode desired.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A multiple use mirror construction comprising frame, base and intermediate support members, said frame having a mirror mounted on the front surface thereof and a rear surface having mounting means including a first portion adapted to support said frame in a hanging position and a second portion adapted for the alternate support of said frame by said intermediate support member, said intermediate support member being of generally elongated configuration and having a central portion adapted for hand grasping, a first end adapted for receipt in said frame mounting means second portion, and a second end adapted for receipt in mounting means provided in said base, and said frame and base mounting means adapted to respectively receive said first and second ends of said intermediate support member in friction locking relationship, said mirror alternatively usable in a wall mounted position when said frame is independently suspended by said mounting means first portion, in a hand held position when said frame is connected to said first end of said intermediate support member, and in a table supported position when said second end of said intermediate member is connected to said base.

2. The mirror construction set forth in claim 1, said intermediate support member terminating respectively in first and second heads, said heads generally aligned with each other and a plane passing through said central portion, said first head pivotally supported with respect to said central portion for arcuate movement within said plane.

3. The mirror construction set forth in claim 2, said frame mounting means including a generally U-shaped open top hollow boss outwardly extending from said rear surface, opposite sides of said boss having inwardly extending flanges, said first head including a pair of inwardly extending slots adapted for receipt of said flanges when said first head is received within said boss.

4. The mirror construction set forth in claim 3, said frame rear surface having a cut out positioned adjacent the open end of said boss, a portion of said rear surface forming a flexible web extending into said cut out and including an upwardly extending stop adapted for locking contact with portions of said first head.

5. The mirror construction set forth in claim 4, said base having connection means including a pair of inwardly extending flanges, said second head of said intermediate support member including a pair of inwardly extending slots for receipt of said flanges when said first head is received within said recess.

6. The mirror construction set forth in claim 5, said base having an upwardly extending portion, said base connection means comprising an inwardly extending open end recess formed in said portion, said recess including a bottom wall and side walls upwardly extending therefrom, a cut out formed in said bottom wall and positioned adjacent the open end of said recess, a base portion forming a flexible web extending into said cut out and including an upwardly extending stop adapted for locking contact with portions of said second head.

7. The mirror construction set forth in claim 6, both said frame boss and said base recess having an inwardly disposed upstanding wall adapted to engage respective leading portions of said first and second heads so as to limit the inward travel of said heads with respect to the mounting means of said frame and said base.

* * * * *